US005212731A

United States Patent [19]

Zimmermann

[11] Patent Number: 5,212,731

[45] Date of Patent: May 18, 1993

[54] APPARATUS FOR PROVIDING SENTENCE-FINAL ACCENTS IN SYNTHESIZED AMERICAN ENGLISH SPEECH

[75] Inventor: Beatrix Zimmermann, Goleta, Calif.

[73] Assignee: Matsushita Electric Industrial Co. Ltd., Osaka, Japan

[21] Appl. No.: 584,530

[22] Filed: Sep. 17, 1990

[51] Int. Cl.[5] ..... G10L 5/00

[52] U.S. Cl. ..... 381/52; 381/51; 395/2

[58] Field of Search ..... 381/51-52; 395/2

[56] References Cited

U.S. PATENT DOCUMENTS

| | | | |
|---|---|---|---|
| 4,624,012 | 11/1986 | Lin et al. | 381/52 |
| 4,695,962 | 9/1987 | Goudie | 395/2 |
| 4,696,042 | 9/1987 | Goudie | 381/51 |
| 4,797,930 | 1/1989 | Goudie | 381/52 |
| 4,799,261 | 1/1989 | Lin et al. | 395/2 |
| 4,802,223 | 1/1989 | Lin et al. | 381/38 |
| 4,908,867 | 3/1990 | Silverman | 381/51 |

OTHER PUBLICATIONS

"Synthesis by Rule of English Intonation Patterns," by Mark D. Anderson et al, from proceedings of IEEE International Conference (1984), pp. 2.8.1-2.8.4.

"The structure and processing of fundamental frequency contours" by Kim E. A. Silverman, submitted for the degree of Doctor of Philosophy, University of Cambridge, Apr., 1987, pp. 5.26-5.49.

"Language Sound Structure" by Mark Aronoff et al, from the Massachusetts Institute of Technology, (1984).

IEEE Computer (Aug. 1990), vol. 23, No. 8 "Text-to-Speech Conversion Technology" by Michael O'-Malley, pp. 17-23.

*Primary Examiner*—Dale M. Shaw
*Assistant Examiner*—Kee M. Tung
*Attorney, Agent, or Firm*—Price, Gess & Ubell

[57] ABSTRACT

A synthetic voice system which can convert typed text to speech calculates the intonation presented by the input text. The system utilizes a pitch (F0) module to calculate an F0 value for the beginning and middle of each phoneme. The following procedure is used. The F0 value for all the stressed syllables are calculated along with all F0 values for the syllables preceding a silence. The calculated F0 values for the syllables are placed on their associated phonemes. The valleys between the stressed syllables are approximated. When the last syllable of a declarative sentence is stressed and in WH question and exclamatory sentences, the FO fall is controlled to be gradual at first and then sharper toward the last utterance. When that last syllable of the declarative sentence is not stressed, the fall is sharper at first and then more gradual toward the last utterance. In "yes/no" questions, there is a final rise after the last stressed syllable of the sentence. The last stressed syllable is assigned a low FO value which is approximately equal to the average FO values of the speaker. To prevent an unnatural sounding, sharp FO rise in these questions when the last accented syllable occurs on the last syllable of the sentence, the final FO rise is lower than that of the "yes/no" question when the last accented syllable does not occur on the last stressed syllable of the sentence.

23 Claims, 3 Drawing Sheets

APPARATUS FOR PROVIDING SENTENCE-FINAL ACCENTS IN SYNTHESIZED AMERICAN ENGLISH SPEECH

BACKGROUND OF THE INVENTION

1. Field of the Invention

The present invention relates to improvements in synthetic voice systems and, in particular, to improvements in intonation.

2. Description of Related Art

Synthetic voice systems which can convert a typed text to the spoken word are known as text-to-speech systems. Although such systems are intelligible, they are often unnatural sounding. One of the problems contributing to the unnaturalness of the sound produced by such text-to-speech systems is the difficulty in calculating the intonation of a voice. Such a calculation is difficult because the intonation in human speech is a product of many different characteristics or factors. Often not enough information can be derived from the input text due to the limitation of time, memory, and semantic information resulting from a computer system being utilized. Intonation components must rely on the information which is presented to them, and the local rules to produce the intonation of the input text. The present invention is a text-to-speech system with an intonation component or pitch module, which provides a more natural sounding speech for sentence-final positions.

SUMMARY OF THE INVENTION

In a text-to-speech system, a pitch (F0) module calculates an F0 value for the beginning and middle points of each phoneme. The F0 values for all stressed syllables are calculated along with the F0 values for the syllables preceding a silence. The calculated F0 values for the syllables are placed on their associated phonemes. The valleys between the stressed syllables are approximated, while the remaining phonemes are filled in by interpolation.

In calculating the FO values for the syllables preceding a silence, in particular when the silence is at the end of the sentence, specific sentence-type dependent rules are applied. In declarative and exclamatory sentences, and WH questions, there is a final FO lowering after the last stressed syllable of the sentence. In these sentence types the last stressed syllable of the sentence is assigned a higher FO value than the average FO values of the speaker. If the sentence is declarative, this FO value is approximately midway between the average FO values of the speaker and the highest FO value of the speaker. In the exclamatory sentence, this FO value is sufficiently higher than that of the declarative sentence (e.g., 30%). In the WH question, this FO value is approximately midway between that of the declarative sentence and the exclamatory sentence. The fall patterns which occur after the last stressed syllable all end up in approximately the same place. When the last syllable of the declarative sentence is stressed and, in WH question and exclamatory sentences, whether stressed or not, the FO fall is controlled to be gradual at first and then sharper toward the last utterance. When that last syllable of the declarative sentence is not stressed, the fall is sharper at first and then more gradual toward the last utterance.

In "yes/no" questions there is a final rise after the last stressed syllable of the sentence. The last stressed syllable is assigned a low FO value which is approximately equal to the average FO values of the speaker. To prevent an unnatural sounding, sharp FO rise in these questions when the last accented syllable occurs on the last syllable of the sentence, the final FO rise is lower than that of the "yes/no" question when the last accented syllable does not occur on the last stressed syllable of the sentence.

BRIEF DESCRIPTION OF THE DRAWINGS

The exact nature of this invention, as well as its objects and advantages, will become readily apparent to those skilled in the art from consideration of the following detailed description, when reviewed in conjunction with the accompanying drawings, in which like reference numerals designate like parts throughout the figures thereof, and wherein.

DESCRIPTION OF THE PREFERRED EMBODIMENTS

Figure 1:
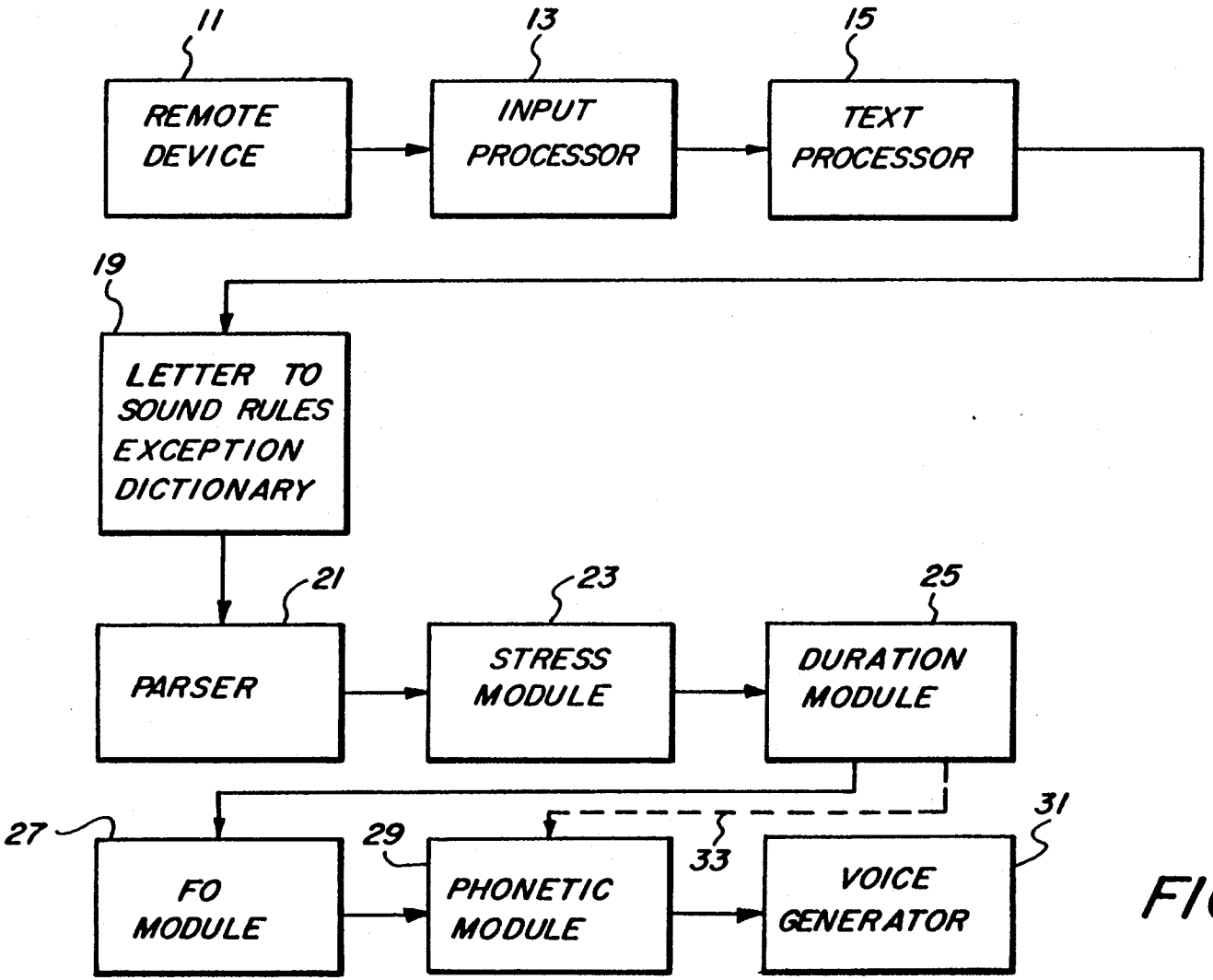
FIG. 1 is a block diagram of a text-to-speech system utilizing the present invention.

The text-to-speech system utilizing the pitch (FO) control of the present invention is illustrated in FIG. 1. As in any text-to-speech system, text characters are sent to an input processor 13 from a remote device 11. When either a full stop has been entered, i.e., a ".", "?", or "!", or a maximum number of characters has been received by the processor 13, it starts to process the input. The text received by the input processor 13 is sent to the text processor 15, which expands a symbolic text received or abbreviations into full text. The text processor 15 sends the full text to the letter-to-sound rules/exception dictionary 19, wherein each word in the text is converted to a series of phonemes by either a dictionary look-up procedure or by the operation of letter-to-sound rules. Module 19 also identifies the stressed syllables of each word. The output of module 19 is a phoneme string with syllable stress information attached. This information is sent to the parser 21, which determines the parts of speech and features of each word. The parts of speech and word features information is passed from the parser 21 to a stress module 23, which defines the clause boundaries and identifies important words. All words which are not considered important are de-stressed by stress module 23. The duration module 25 also takes all words and performs some phoneme transcriptions. The duration module 25 calculates the duration of each phoneme and inserts silences wherever appropriate.

This information is passed on to the pitch (F0) module 27, which calculates an F0 value for the beginning and middle points of each phoneme received. The F0 module accomplishes this by first calculating the F0 values for all the stressed syllables, and for the syllable(s) preceding a silence. Recall that silences were inserted in the duration module 25. All the F0 values which were calculated for the stress syllables, and the syllable(s) preceding a silence are then placed in association with their respective phonemes. The valleys between the stress syllables are approximated and the remainder of the phonemes, which have not yet been assigned a value, are filled in using a simple interpolation method.

After the F0 values have been calculated, they are passed on to a phonetic module 29, which calculates the phonetic parameters. The phonetic parameter calculation requires the target values of the parameters for each phoneme, as well as its duration and F0 values. Phonetic module 29 receives the duration and target value information from duration module 25 over line 33. The phonetic module 29 performs an interpolation between the target values for each of the phonetic parameters. Upon completion of that calculation, the phonetic parameters are sent to the voice generator 31, which produces the speech.

The FO module 27 of the present invention assigns FO values to each stressed syllable and to the syllable(s) preceding a silence. The FO value assigned to each stressed syllable is often higher than the other FO values in the sentence and is based on several features of the word in which it is contained. This feature information can partially be obtained from the parser module 21.

There are two FO values assigned to the syllable(s) which occur between the last stressed syllable before the silence and the silence itself. When that silence is not the end of the sentence, these syllable(s) are assigned a fall-rise pattern. The fall in the fall-rise pattern occurs after the last stressed syllable preceding the silence and the rise occurs after the fall but before the silence. If the last stressed syllable before the silence is the last syllable before the silence, all three FO values (the stressed syllable FO value, the fall FO value, and the rise FO value) are placed on that one syllable. When the silence is at the end of the sentence, the FO values assigned are dependent on the type of sentence. In this case, there are also two FO values assigned to the syllable(s) which occur between the last stressed syllable before the silence and the silence itself. These FO values are discussed later.

After the FO values are assigned to the stressed syllables and the syllable(s) preceding a silence, these FO values are placed in association with their respective phonemes. The FO values assigned to the stressed syllables are placed at the beginning of the phoneme following the vowel phoneme of the stressed syllable. The rise FO value assigned to the syllable(s) preceding a silence is assigned to the beginning of the silence phoneme or the first nonvoiced phoneme before the silence. The fall FO value is assigned to the phoneme between the last stressed syllable and the silence.

After the FO values are placed in association with their respective phonemes, valleys between the stressed syllables are approximated and the remainder of the phonemes filled in using a simple interpolation method.

The pitch module 27 operates in accordance with the following definitions:

"Sentence" is any string of one or more words ending with an end of sentence marker such as a ".", a "?", or an "!".

"Declarative sentence" is any sentence that ends with a "."

"Exclamatory sentence" is any sentence that ends with an "!"

"WH question" is any sentence that ends with a question mark, contains one of the WH words, such as "who," "how," "why," "what," "where," "whom," "whose," "which," and "when," and does not expect a "yes" or "no" reply.

"Yes/no question" is any sentence that ends with a "?" which is expecting a reply of either "yes" or "no."

It has been claimed by Lieberman and Pierrehumbert that declarative sentences have final F0 lowering, and it has been discovered that "yes/no" questions have a low F0 value on the last accented syllable, and then rise to the end of the sentence by Pierrehumbert. Little to no research has been directed towards the shape and rise of the FO contour in these contexts; in other words, in the context of declarative sentences and "yes/no" questions.

When the last accented syllable of a sentence occurs at the end of the sentence, its FO contour consists not only of a word accent, but also the phrase and sentence-final accents; i.e., when this syllable has a short duration, its fluctuating F0 contour has an unnatural quality. One solution introduced by Anderson and modified by Silverman is to shift the accents leftward, allowing more time for the movement to occur. This is not an acceptable solution for a synthesizer that only performs phoneme level F0 adjustments, as F0 module 27.

Figure 2:
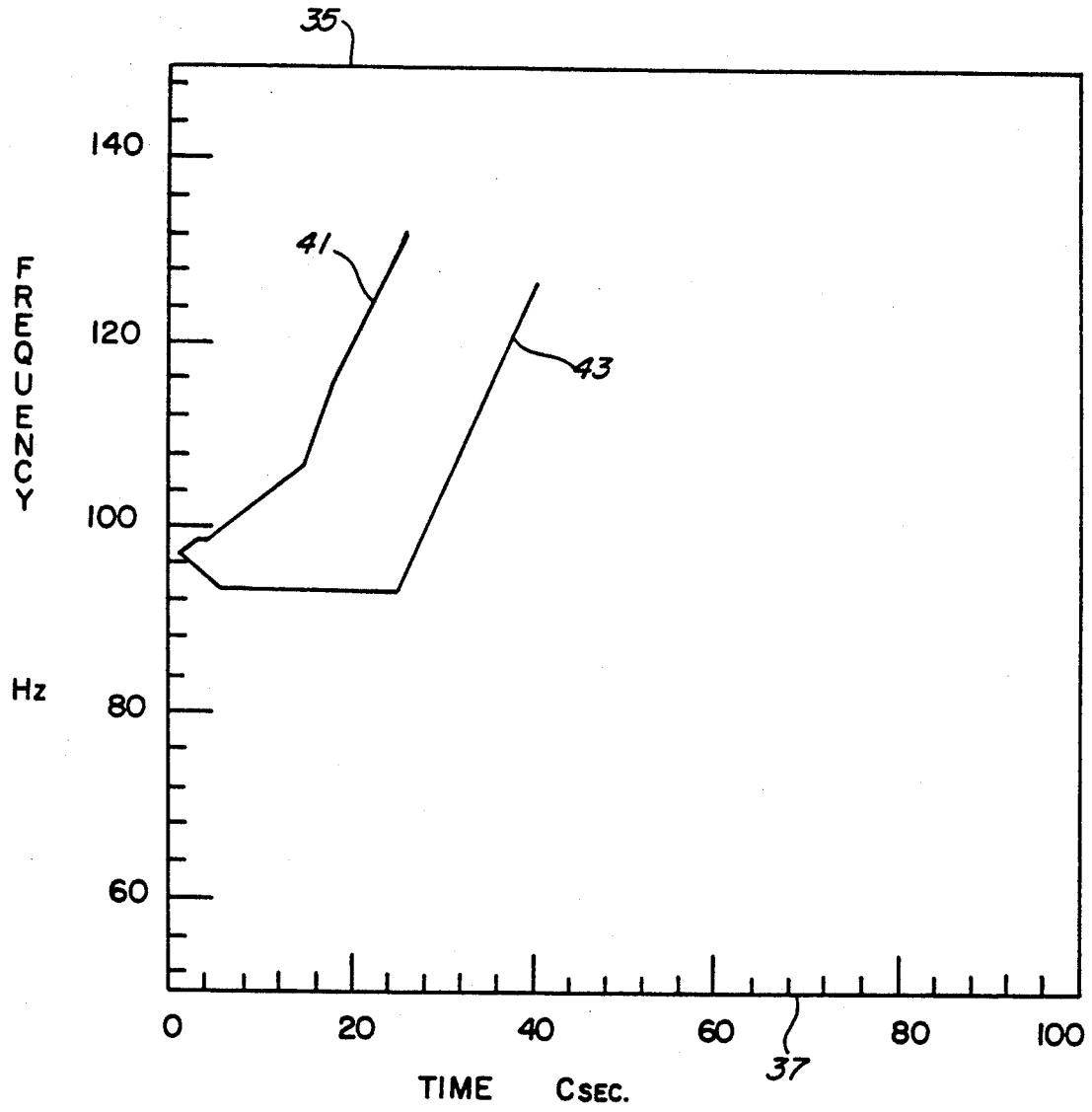
FIG. 2 is a graph showing the pitch variations of the last syllable in a "yes/no" question when controlled by the present invention.

The F0 value assigned by F0 module 27 when the last syllable of a "yes/no" question is stressed is lower than when the last syllable of a "yes/no" question is not stressed. This is illustrated in FIG. 2. FIG. 2 shows curves 41 and 43 plotted against frequency on the Y axis 35 and time against the X axis 37. Curve 41 illustrates a "yes/no" question with the last syllable not stressed. Curve 43 illustrates the operation of F0 module 27 in lowering the final F0 value when the last syllable is stressed, thereby preventing an unnatural sharp F0 rise.

Figure 3:
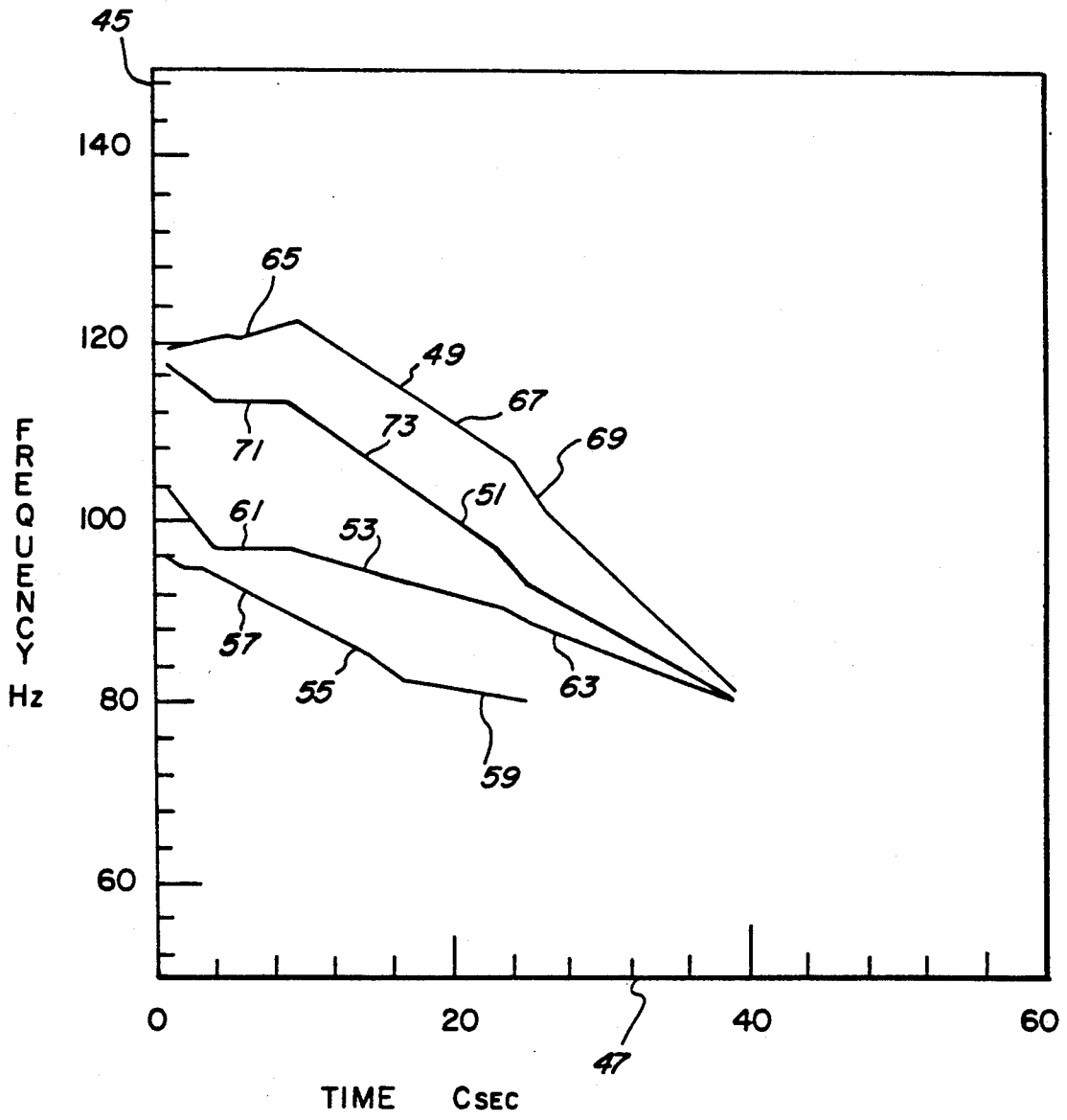
FIG. 3 is a graph showing the controlled pitch variations of the last syllable of the sentence according to the present invention of a declarative sentence, exclamatory sentence, and a WH question.

To avoid an unnatural sharp F0 fall in a declarative sentence, similar F0 adjustments are performed by F0 module 27, as illustrated in FIG. 3. FIG. 3 shows curves 49, 51, 53, and 55 plotted against frequency on the Y axis 45 and time on the X axis 47. Curve 55 shows a declarative sentence when the last syllable is not stressed. The fall of F0 is sharp through the area 57 and becomes more gradual at area 59. Curve 53 illustrates a declarative sentence which has the last syllable stressed. To avoid an unnatural sharp F0 fall, final F0 lowering is gradual at area 61 and becomes a little sharper towards the last utterance in area 63.

Curve 49 illustrates what happens in an exclamatory sentence in the system of the present invention when the last syllable is stressed. The exclamatory sentence receives a final F0 lowering similar to the declarative sentence.

However, the FO value of the last stressed syllable is increased from that of the declarative sentence by a sufficient amount (e.g., 30%), as can be seen in area 65. In this sentence type, the shape of the fall from FO value of the last stressed syllable is slightly more gradual at first (area 67) and then sharper toward the last utterance of the sentence (area 69). Although the fall from the last stressed syllable to the end of the sentence is sharp, it does not have an unpleasant sound, perhaps due to the listener's expectation of an exclamatory sentence. If the last syllable is not stressed, the same fall will occur over a longer period of time, because there would be more time between the stressed syllable and the end of the sentence.

The contour of the fall from FO value of the last stressed syllable in a WH question is shown in curve 51. The FO value of the last stressed syllable is between that of the exclamatory sentence and that of the declarative sentence (area 71). The shape of the fall is also between these two types of sentences with a slightly sharper decrease in the beginning of area 73. Similar to the exclamatory sentence, although the fall from the last stressed syllable to the end of the sentence is sharp, it does not have an unpleasant sound, perhaps due to the listener's expectation of a WH question. Again, if the last syllable is not stressed, the same fall will occur over a longer period of time, because there would be more time between the stressed syllable and the end of the sentence.

What has been described is a method of creating a more natural intonation when the last accented syllable of a declarative sentence, a "yes/no" question, an exclamatory sentence, or a "WH" question occurs at the end of the sentence.

What is claimed is:

1. In a phoneme-based test-to-speech synthetic voice system having means for generating spoke sentences composed of a plurality of syllables, wherein some of said syllables are stressed, and wherein some of said syllables precede periods of silence, having means for determining whether each of the sentences is declarative, exclamatory, or a question, and having a pitch module for determining FO values representative of pitch for assigning to selected portions of selected phonemes of stressed syllables, the improvement in said pitch module of said system comprising: means for determining whether a question sentence is a "yes/no" question or a "WH" question; and means for determining appropriate FO values for assigning to the selected phonemes of a last stressed syllable before a period of silence at an end of a sentence, with different FO values being determined and assigned depending upon whether the sentence is declarative, exclamatory, a "yes/no" question, or a WH question.

2. The improvement of claim 1 wherein, in case of a declarative sentence, said FO value determination means assigns a FO value approximately midway between an average FO value being assigned and a highest FO value being assigned; and, in case of an exclamatory sentence, assigns a FO value that is higher than the FO value assigned in the declarative sentence case.

3. The improvement of claim 2 wherein, in case of an exclamatory sentence, said assigned FO value is approximately 30% higher than the FO value assigned in the declarative sentence case.

4. The improvement of claim 2 wherein, in the case of a WH question, said FO value determination means assigns a FO value approximately midway between the FO value assigned in the declarative case and the FO value assigned in the exclamatory case.

5. The improvement of claim 1 further comprising: means for controlling a FO value fall pattern occurring after the last stressed syllable, depending on whether the type of sentence is declarative, exclamatory, or a WH question, and upon whether there is at least one unstressed syllable following the last stressed syllable before the period of silence and the end of the sentence.

6. The improvement of claim 5 wherein, in case of a declarative sentence, the last syllable is stressed, and the FO value fall is controlled to be gradual at first and then sharper.

7. The improvement of claim 5 wherein, in case of a declarative sentence, the last syllable is not stressed, and the FO value fall is controlled to be sharper at first and then more gradual.

8. The improvement of claim 5 wherein, in case of an exclamatory sentence, whether the last syllable is stressed or not, the FO value fall is controlled to be gradual at first and then sharper.

9. The improvement of claim 5 wherein, in case of a WH question, whether the last syllable is stressed or not, the FO value fall is controlled to be gradual at first and then sharper.

10. The improvement of claim 9 wherein the FO value fall for a WH question is between the FO fall value for the exclamatory and declarative sentences.

11. In a phoneme-based text-to-speech synthetic voice system having means for generating spoken sentences composed of a plurality of syllables, wherein some of said syllables are stressed, and wherein some of said syllables precede periods of silence, having means for determining whether each of the sentences is declarative, exclamatory, or a question, and having a pitch module for determining FO values representative of pitch for assigning to selected portions of selected phonemes of stressed syllables, the improvement in said pitch module of said system comprising: means for determining whether a question sentence is a "yes/no" question or a "WH" question; and means for controlling a FO value fall pattern for declarative sentences, exclamatory sentences, or "WH" questions, said FO value fall pattern occurring after a last stressed syllable before a period of silence at an end of a sentence, said FO value fall pattern being different, depending on whether the sentence is declarative, exclamatory, or a WH question, and whether there is at least one unstressed syllable following the last stressed syllable before the end of the sentence, and wherein the FO value fall pattern is controlled to achieve a common final pitch for exclamatory sentences, declarative sentences, and "WH" questions.

12. The improvement of claim 11 wherein, in case of a declarative sentence, the last syllable is stressed, and the FO value fall is controlled to be gradual at first and then sharper.

13. The improvement of claim 11 wherein, in case of a declarative sentence, the last syllable is not stressed, and the FO value fall is controlled to be sharper at first and then more gradual.

14. The improvement of claim 11 wherein, in case of an exclamatory sentence, whether the last syllable is stressed or not, the FO value fall is controlled to be gradual at first and then sharper.

15. The improvement of claim 11 wherein, in case of a WH question, whether the last syllable is stressed or not, the FO value fall is controlled to be gradual at first and then sharper.

16. The improvement of claim 15 wherein the FO fall value for WH questions is between the fall value for the exclamatory and declarative sentences.

17. The text-to-speech synthetic voice system of claim 11, further including means for controlling a FO value rise pattern occurring after a last stressed syllable before a period of silence at an end of a sentence in a "yes/no" question to be high relative to an average pitch when a last syllable is not stressed, and to be less high when the last syllable is stressed.

18. A text-to-speech synthetic voice system comprising:

means for receiving an input text string having one or more sentences;

means for identifying a set of syllables corresponding to said text and for identifying sets of phonemes corresponding to said syllables;

means for identifying stressed syllables and a period of silence at an end of a sentence in said text;

means for determining whether each of the sentences is declarative, exclamatory, a "yes/no" question, or a WH question;

pitch module means for determining one or more FO values representative of pitch for assigning to selected portions of selected phonemes, said pitch module means including means for controlling a FO value fall pattern occurring after a last stressed syllable before the period of silence at the end of the sentence, depending on whether the sentence is declarative, exclamatory, a "yes/no" question, or a WH question, and depending upon whether there is at least one unstressed syllable following the last stressed syllable of the sentence; and means for generating an output speech signal based on said phonemes, said FO values, and said FO value fall patterns.

19. The text-to-speech voice system of claim 18 wherein, in case of a declarative sentence where the last syllable is stressed, the FO value fall is controlled to be gradual at first and then sharper.

20. The text-to-speech voice system of claim 18 wherein, in case of a declarative sentence where the last syllable is not stressed, the FO value fall is controlled to be sharp at first and then more gradual.

21. The text-to-speech voice system of claim 18 wherein, in case of an exclamatory sentence, whether the last syllable is stressed or not, the FO value is controlled to be gradual at first and then sharper.

22. The text-to-speech voice system of claim 18 wherein, in case of a WH question, whether the last syllable is stressed or not, the FO value fall is controlled to be gradual at first and then sharper.

23. The text-to-speech voice system of claim 18 wherein the FO fall value for WH questions is between the fall value for the exclamatory and declarative sentences.

* * * * *